US007591519B2

(12) United States Patent
Tatsumi

(10) Patent No.: US 7,591,519 B2
(45) Date of Patent: Sep. 22, 2009

(54) LIQUID DROPLET EJECTION APPARATUS AND IMAGE FORMING APPARATUS

(75) Inventor: Setsuji Tatsumi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 400 days.

(21) Appl. No.: 11/093,278

(22) Filed: Mar. 30, 2005

(65) Prior Publication Data

US 2005/0219287 A1 Oct. 6, 2005

(30) Foreign Application Priority Data

Mar. 31, 2004 (JP) ..... 2004-107849

(51) Int. Cl.
*B41J 29/38* (2006.01)
*B41J 23/00* (2006.01)

(52) U.S. Cl. ..... 347/9; 347/37

(58) Field of Classification Search ..... 347/40, 347/9, 37, 13, 42

See application file for complete search history.

(56) References Cited

U.S. PATENT DOCUMENTS 6,048,052 A * 4/2000 Kitahara et al. ..... 347/70
6,460,969 B1 * 10/2002 Pinkernell ..... 347/43
6,488,355 B2 * 12/2002 Nakamura et al. ..... 347/40
6,793,319 B2 * 9/2004 Ikemoto et al. ..... 347/40
7,008,042 B2 * 3/2006 Niekawa ..... 347/43
2002/0060715 A1 * 5/2002 Karita et al. ..... 347/42
2003/0052941 A1 * 3/2003 Sato et al. ..... 347/41

FOREIGN PATENT DOCUMENTS

JP 20011334661 A 12/2001

* cited by examiner

*Primary Examiner*—Julian D Huffman
*Assistant Examiner*—Jason S Uhlenhake
(74) *Attorney, Agent, or Firm*—Birch, Stewart, Kolasch & Birch, LLP

(57) ABSTRACT

The liquid droplet ejection apparatus includes a droplet ejection control device controlling droplet ejection whereby droplets of liquid are ejected from ejection heads ("heads") towards an ejection receiving medium together with relative movement caused by a conveying device, and a row of dots is formed by droplets of the liquid landing on the ejection receiving medium wherein at least some of the dots overlap in a main scanning direction substantially perpendicular to the relative movement direction. When a position between nozzles at which a droplet ejection time difference between adjacent dots in the main scanning direction in one head differs from a droplet ejection time difference between other adjacent dots, referred to as a specific time difference nozzle pair position in a corresponding head, the head is positioned so that the specific time difference nozzle pair position differs in the main scanning direction between at least two of the heads.

15 Claims, 14 Drawing Sheets

190
116
116

192
190
116

194
196
116
196
194
116

LIQUID DROPLET EJECTION APPARATUS AND IMAGE FORMING APPARATUS

BACKGROUND OF THE INVENTION

1. Field of the Invention

The present invention relates to a liquid droplet ejection apparatus and an image forming apparatus, and more particularly to a structure of a liquid droplet ejection apparatus that uses an ejection head in which numerous liquid droplet ejection ports (nozzles) are arranged two-dimensionally in high density, and to an image forming apparatus which forms an image on a recording medium using liquid droplets ejected from the liquid droplet ejection apparatus.

2. Description of the Related Art

An inkjet recording apparatus causes ink droplets to be ejected onto a recording medium by ejecting ink from a recording head in accordance with a printing signal while causing recording paper or another recording medium to move relative to the recording head (ejection head) provided with nozzles for ink ejection, thereby forming an image using these ink dots.

Increased nozzle density is desired for enabling photo-quality high-resolution printing, and a technique related to this object is disclosed in Japanese Patent Application Publication No. 2001-334661 which achieves high nozzle density by a configuration in which rectangular chambers (pressure chambers) corresponding to the nozzles are arranged two-dimensionally in a matrix.

However, when the nozzle density is increased using the technique disclosed in Japanese Patent Application Publication No. 2001-334661, and a full-line recording head is structured having rows of nozzles that have a length corresponding to the entire width of the image recordable width, irregularities in the image saturation of the printed result sometimes occur due to differences in the extent of liquid droplet aggregation on the recording medium that occur due to differences in ejection time between adjacent dots. This phenomenon and its causes will be described in general using FIGS. 11 to 13C.

In FIG. 11, the reference numeral 110 indicates the full-line inkjet head (hereinafter referred to as the "head"), and the reference numeral 116 indicates the recording medium (paper, for example). In this arrangement, the recording medium 116 is conveyed from the bottom to the top of FIG. 11 (in the direction of the arrow S). The head 110 has a length corresponding to the entire width W of the recording medium 116, and is fixedly mounted so as to extend along the direction substantially perpendicular to the delivering direction of the recording medium 116.

The head 110 has a structure in which the ink chamber units (liquid droplet ejection elements) 153 made up of the nozzles 151, which are ink droplet ejection ports, the pressure chambers 152 corresponding to the nozzles 151, and other components are arranged (two-dimensionally) in a matrix all along the length corresponding to the entire width W of the recording medium 116. Specifically, a matrix structure is formed in which nozzle rows are formed in the travel direction in the direction perpendicular (the direction of the arrow M; the main scanning direction) to the delivering direction (the direction of the arrow S; the sub-scanning direction) of the recording medium 116, and in an oblique row direction at a certain angle θ not perpendicular to the travel direction. The reference numeral 154 indicates an ink supply port to the pressure chamber 152.

As shown in the magnified view of FIG. 12, when the pitch between nozzles in the row direction having the angle θ with respect to the travel direction (main scanning direction) is "d," the substantial nozzle pitch P projected so as to align with the main scanning direction becomes d×cos θ.

In a full-line head comprising rows of nozzles that have a length corresponding to the entire width of the image recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 151 arranged in a matrix are driven, the main scanning according to the above-described (3) is preferred. More specifically, the nozzles 151-11, 151-12, 151-13, 151-14, 151-15 and 151-16 are treated as a block (additionally; the nozzles 151-21, 151-22, . . . , 151-26 are treated as another block; the nozzles 151-31, 151-32, . . . , 151-36 are treated as another block, . . . ); and one line is printed in the width direction of the recording paper 116A by sequentially driving the nozzles 151-11, 151-12, . . . , 151-16 in accordance with the conveyance velocity of the recording paper 116.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

When the nozzle drive described in (3) above is performed by the head 110 having the nozzle arrangement structure shown in FIG. 12, the time interval during which two adjacent dots are deposited in the main scanning direction varies according to the combination of nozzles. In other words, when ejection is driven from one end of the nozzle block in the sequence **151-*i*1→151-*i*2→151-*i*3→ . . . →151-*i*6 (wherein i is an integer) according to the sequence of (3) above, dots deposited by 151-*i*1 and 151-*m*6 (wherein m=i+1) are adjacent to each other on the recording medium 116, but the time interval during which these two dots are deposited differs from and becomes large with respect to the ejection time difference between dots deposited by other nozzles (for example, 151-*i*1 and 151-*i*2, 151-*i*2 and 151-*i*3**, and others).

When the recording medium 116 is conveyed at high velocity, or in the case of a medium that is slow to stabilize, ejection by the adjacent nozzle is performed with the previously ejected ink droplet already on the recording medium 116. Whereupon, the liquid droplets come in contact with each other on the surface of the recording medium 116, and subsequently ejected liquid droplets are pulled toward and coalesce with the already ejected liquid droplets (see FIGS. 13A to 13C).

As shown in FIG. 13A, immediately after landing on the recording medium 116, the previously ejected liquid droplet 190 has a small surface area of contact with the recording medium 116, but the liquid droplet 190 eventually spreads as time elapses, and continues to soak into the recording medium 116 as shown by the dot-dashed line in FIG. 13A.

As shown in FIG. 13B, before the liquid droplet 190 has been completely absorbed into the recording medium 116 (in the state in which the liquid droplet 190 is present on the surface of the recording medium 116), when the subsequent liquid droplet 192 (second droplet) is ejected, these liquid droplets 190 and 192 come in contact with each other on the surface of the recording medium 116, and, as shown in FIG. 13C, the second liquid droplet 192 is pulled toward and coalesces with the first liquid droplet 190. As a result, the coalesced dot 196 is formed in a position displaced to the left of the original dot position 194 indicated by the dashed line in the same figure. At this time, the left side of the coalesced dot 196 is formed larger with respect to the size of the dot when the first liquid droplet 190 is fixed by itself.

The phenomenon described above occurs continuously within the nozzle block. Describing the liquid droplet ejected from the nozzle 151-*i*6 last in line in the nozzle block, the dot deposited by this nozzle 151-*i*6 thus comes in contact with the two dots that include the dot deposited by the nozzle 151-*i*5 and the dot deposited by the nozzle 151-*m*1 (wherein m=i+1), but since the dot deposited by the nozzle 151-*m*1 is deposited at an earlier time than the dot deposited by the nozzle 151-*i*6 (deposited at the same timing as the dot deposited by the nozzle 151-*i*1), it is fixed sooner. Therefore, the dot deposited by the nozzle 151-*i*6 is drawn toward the dot deposited by the nozzle 151-*i*5 immediately to the left thereof, with which the ejection time difference is small.

The results of this droplet deposition are shown in FIGS. 14A and 14B. FIG. 14A is a schematic view showing the positioning of the dots after the fluid has moved due to aggregation of the deposited dots, and FIG. 14B is a schematic view of the results of aggregation of groups of dots in the same row in the paper conveyance direction (sub-scanning direction).

As shown in FIGS. 14A and 14B, the distance PD1 between adjacent dots deposited by the nozzles 151-*i*6 and 151-*m*1 becomes larger than the distance PD2 between adjacent dots deposited by the other nozzles 151-*i*1 through 151-*i*6, and a portion having a lesser concentration compared to other portions is formed in the position on the recording medium 116 that corresponds to the space between these nozzles 151-*i*6 and 151-*m*1. When sub-scanning is performed while the recording medium 116 is conveyed, since the phenomenon described above is repeated in the same manner in the sub-scanning direction, an uneven band of lesser concentration appears in the position corresponding to the space between the nozzles 151-*i*6 and 151-*m*1 (see FIG. 14B). The period with which this uneven band is repeated (the spatial repetition cycle) becomes the period of the pitch of one row along the row direction that is slanted at angle θ in the two-dimensional arrangement of the nozzles 151 described using FIGS. 11 and 12 (the distance between nozzles 151-11 and 151-21; specifically, the pitch of the nozzle blocks in the row direction).

In the case of a high-density head which achieves photo-quality high-resolution printing, since this period is about 0.1 mm to 1 mm, it overlaps a period that is easily recognizable to the human eye, and is identified as an undesirable banding artifact.

An example is described above in which an ink droplet deposited on the recording medium is fixed thereon by soaking into the recording medium, but aggregation also occurs in a system in which the ink droplet deposited onto the recording medium is fixed on the recording medium by curing (hardening) or drying. The same drawbacks as in the abovementioned case of fixation by soaking therefore also occur in the case of fixation by curing or drying.

SUMMARY OF THE INVENTION

The present invention has been contrived in view of such circumstances, and an object thereof is to provide a liquid droplet ejection apparatus whereby the visibility of striping caused by the two-dimensional arrangement structure of the nozzles and the difference between the deposition times of adjacent dots can be reduced, and to provide an image forming apparatus that uses this liquid droplet ejection apparatus.

In order to attain the aforementioned object, the present invention is directed to a liquid droplet ejection apparatus, comprising: a plurality of ejection heads having an ejection surface in which nozzles for ejecting droplets of liquid towards an ejection receiving medium are arranged two-dimensionally; a conveying device which conveys at least one of the ejection heads and the ejection receiving medium in a fixed direction to cause relative movement of the ejection heads and the ejection receiving medium in a relative movement direction; and a droplet ejection control device which performs droplet ejection control whereby droplets of the liquid are ejected from the ejection heads towards the ejection receiving medium together with the relative movement caused by the conveying device, and a row of dots is formed by the droplets of the liquid landing on the ejection receiving medium in which at least some of the dots overlap in a main scanning direction substantially perpendicular to the relative movement direction, wherein when a position between nozzles at which a droplet ejection time difference between adjacent dots in the main scanning direction in one ejection head differs from a droplet ejection time difference between other adjacent dots is referred to as a specific time difference nozzle pair position in a corresponding ejection head, the ejection head is positioned so that the specific time difference nozzle pair position differs in the main scanning direction between at least two of the ejection heads.

In an ejection head having two-dimensionally arranged nozzle groups, the droplet ejection time difference between adjacent dots varies according to the positional relation between nozzles which deposit adjacent dots in the main scanning direction. For example, when adjacent dots are deposited by nozzles that are adjacent to each other in the nozzle sequence of the ejection head, the droplet ejection time difference (T1) between these adjacent dots is relatively small. In contrast, when adjacent dots in the main scanning direction are formed by two nozzles that are relatively isolated from each other in the nozzle sequence, the droplet ejection time difference (T2) between these adjacent dots becomes relatively large. Such a difference in the droplet ejection time differences causes the aggregation behavior of the landed liquid droplets to change, and the uneven concentration that occurs due to coalesced dots is as described by FIGS. 11 to 13C.

In other words, uneven concentration occurs in the position between nozzles in which the droplet ejection time difference between adjacent dots in the main scanning direction differs from the droplet ejection time difference between the other more numerous adjacent dots (referred to in the present specification as the "specific time difference nozzle pair position").

By the present invention, describing one ejection head, uneven concentration occurs in the droplet ejection position on the ejection receiving medium that corresponds to the specific time difference nozzle pair position, but since the specific time difference nozzle pair position is caused to differ in the main scanning direction among a plurality of ejection heads, the position in which the uneven concentration produced by these ejection heads occurs does not overlap on the same row in the direction of the relative movement (sub-scanning direction) caused by the conveying device. Thus, the amplitude of the uneven concentration is reduced, while at the same time, the spatial repetition cycle of the uneven concentration in the main scanning direction is shortened (the spatial frequency increases), and the uneven concentration becomes difficult for the human eye to discern.

The range of application of the present invention is not limited to a case in which a liquid droplet deposited onto a printed medium soaks into and is fixed on the ejection receiving medium. Since aggregation also occurs in a system in which the ink droplet deposited onto the reception receiving medium is fixed on the ejection receiving medium by curing (hardening) or drying, the present invention can also be applied to aggregation that occurs in a fixing process that uses curing or drying.

Preferably, a spatial repetition cycle of the specific time difference nozzle pair position in the main scanning direction in the ejection heads is shared, and the ejection heads are arranged so that a phase of the repetition cycle between n (wherein n is an integer not less than 2) ejection heads is displaced by substantially 1/n. Thus, the repetition cycle of the uneven concentration is set to substantially 1/n (the frequency is multiplied by n) by arranging the ejection heads so that the phase of the repetition cycle of the specific time difference nozzle pair position between n ejection heads is displaced by substantially 1/n.

Preferably, the ejection heads are full-line heads formed by two-dimensionally arranged nozzle groups extending all along a length that corresponds to an entire width of the ejection receiving medium.

The liquid droplet ejection apparatus of the present invention can be suitably used in the structure of a so-called single-pass system whereby a row of dots having a length that corresponds to the entire width of the ejection receiving medium can be formed by relative movement in one direction only (by performing sub-scanning only once) using the full-line ejection head.

A "full-line recording head (discharge head)" is normally disposed along the direction perpendicular to the relative delivering direction of the printing medium (the conveyance direction), but also possible is an aspect in which the recording head is disposed along the diagonal direction given a predetermined angle with respect to the direction perpendicular to the conveyance direction.

Preferably, the nozzles are arranged in a matrix along a column direction substantially perpendicular to the relative movement direction and in an oblique row direction having a certain angle with respect to the column direction; and each block of nozzle rows along the column direction is driven in sequence from the nozzle on one end of each block to the nozzle on the other end thereof, whereby a row of dots is formed along the main scanning direction.

An embodiment in which the nozzles are in a two-dimensional arrangement is described as this aspect of the invention.

Preferably, the specific time difference nozzle pair positions correspond to boundary portions of the blocks in the nozzle row.

Preferably, the blocks in the nozzle rows are composed of an even number of nozzles.

By adopting a configuration in which the blocks (referred to as nozzle blocks) in the nozzle rows arranged in the oblique row direction are composed of an even number of nozzles, particularly when the phase is displaced by ½, ⅓, or the like, it is possible to overlap deposited dots from different ejection heads in the same position on the ejection receiving medium.

Preferably, the plurality of ejection heads comprise two ejection heads which each ejects at least two colors of ink from among cyan (C), magenta (M), and black (K).

A preferred aspect is one which displaces the position in which striping occurs between the plurality of ejection heads which eject ink having a color whereby contrast is relatively easy to distinguish.

Preferably, the at least two ejection heads which place the specific time difference nozzle pair positions so as to differ in the main scanning direction comprise two ejection heads which eject ink having the same hue.

Preferably, the at least two ejection heads which place the specific time difference nozzle pair positions so as to differ in the main scanning direction comprise two ejection heads which eject dark ink and light ink, respectively, composed of a same dye.

Preferably, the ejection head has a nozzle arrangement structure whereby the distance in the main scanning direction between nozzles, whereby the ejection time difference between adjacent dots in the main scanning direction is longer than the ejection time difference between other adjacent dots, is set to be smaller than the distance in the main scanning direction between other nozzles.

Since the distance in the main scanning direction between nozzles (distance between nozzles in the main scanning direction) having a long ejection time interval is set to be smaller than the distance between other nozzles, the width in which concentration is reduced becomes narrow, and striping becomes significantly harder to distinguish.

Preferably, droplet ejection control is performed which places the dots so that the distance between dots in the main scanning direction whereby the ejection time difference between adjacent dots in the main scanning direction differs from the ejection time difference between other adjacent dots is caused to differ from the distance between dots in the main scanning direction for other adjacent dots for at least one of the ejection heads.

The width in which concentration is reduced may be narrowed by contriving the structure of the nozzle sequence as described above. Dot placement may be performed that is essentially the same as that of the ejection head described above by contriving the droplet ejection control. For example, there may be an aspect which controls the landing position provided with a device which deflects flying liquid droplets, and there may also be an aspect which controls the direction of ejection from the nozzles.

Preferably, a plurality of nozzles are formed in the ejection head in line with the sub-scanning direction along the relative movement direction in the specific time difference nozzle pair position, and droplet ejection is performed selectively from the plurality of nozzles in the same sub-scanning direction line.

By changing the droplet ejection timing of dots in the nozzle positions by forming a plurality of nozzles in line with the sub-scanning direction in at least one nozzle position of the pair of nozzles in the specific time difference nozzle pair position, and selectively driving the plurality of nozzles positioned in overlapping fashion in line with the sub-scanning direction, it becomes possible to appropriately mix dots that are pulled towards the dots of the previous ejection with dots that are not drawn thereto, portions in which the concentration becomes thin are reduced, and the visibility of striping is reduced.

The individualized usage of the plurality of nozzles arranged in overlapping fashion in line with the sub-scanning direction may be switched at random, and may be switched in orderly fashion (for example, in alternate fashion in the case of two nozzles).

In order to attain the aforementioned object, the present invention is also directed to a liquid droplet ejection apparatus, comprising: an ejection head having an ejection surface in which nozzles for ejecting droplets of liquid towards an ejection receiving medium are arranged two-dimensionally; a conveying device which conveys at least one of the ejection head and the ejection receiving medium in a fixed direction to cause relative movement of the ejection head and the ejection receiving medium in a relative movement direction; and a droplet ejection control device which performs droplet ejection control whereby droplets of the liquid are ejected from the ejection head towards the ejection receiving medium together with the relative movement caused by the conveying device, and a row of dots is formed by the droplets of the liquid landing on the ejection receiving medium in which at least some of the dots overlap in a main scanning direction substantially perpendicular to the relative movement direction, wherein the ejection head has a nozzle arrangement structure whereby the distance in the main scanning direction between nozzles, whereby the ejection time difference between adjacent dots in the main scanning direction in the ejection head is longer than the ejection time difference between other adjacent dots, is set to be smaller than the distance in the main scanning direction between other nozzles.

Since the distance between nozzles (pitch) in the main scanning direction between nozzles having a long droplet ejection time interval is set smaller than the distance between other nozzles, the width in which the concentration is reduced is narrowed, and striping becomes difficult to distinguish.

In order to attain the aforementioned object, the present invention is also directed to a liquid droplet ejection apparatus, comprising: an ejection head having an ejection surface in which nozzles for ejecting droplets of liquid towards an ejection receiving medium are arranged two-dimensionally; a conveying device which conveys at least one of the ejection head and the ejection receiving medium in a fixed direction to cause relative movement of the ejection head and the ejection receiving medium in a relative movement direction; and a droplet ejection control device which performs droplet ejection control whereby droplets of the liquid are ejected from the ejection head towards the ejection receiving medium together with the relative movement caused by the conveying device, and a row of dots is formed by the droplets of the liquid landing on the ejection receiving medium in which at least some of the dots overlap in a main scanning direction substantially perpendicular to the relative movement direction, wherein: when a position between nozzles at which a droplet ejection time difference between adjacent dots in the main scanning direction in the ejection head differs from a droplet ejection time difference between other adjacent dots is referred to as a specific time difference nozzle pair position in a corresponding ejection head, the plurality of nozzles are formed in line with the sub-scanning direction along the relative movement direction in the specific time difference nozzle pair position in the ejection head; and the droplet ejection control device performs control which causes the plurality of nozzles formed in the same sub-scanning direction line to selectively eject.

The plurality of nozzles arranged in overlapping fashion in line with the sub-scanning direction are selectively driven, whereby the droplet ejection timing of the dots in the corresponding nozzle positions can be changed, and it becomes possible to appropriately mix dots that are pulled towards the dots of the previous ejection with dots that are not drawn thereto. The number of portions in which the concentration decreases is thereby reduced, and the visibility of striping is reduced.

In order to attain the aforementioned object, the present invention is also directed to an image forming apparatus, comprising: the above-described liquid droplet ejection apparatus, wherein the image forming apparatus forms an image on the ejection receiving medium using liquid droplets ejected from the nozzles.

The term "printed medium" refers to a medium onto which the liquid droplets ejected from the ejection head are ejected (on which an image is formed using dots), and can be referred to as a recording medium, a printing medium, an image formation medium, a recorded medium, an image-receiving medium, or the like. The ejection receiving medium includes continuous paper, cut paper, sealing paper, OHP sheets and other resin sheets, films, cloth, a printed substrate on which a wiring pattern or the like is formed by an inkjet recording apparatus, an intermediate transfer medium, and various other media regardless of the material or form thereof. The term "printing" used in the present specification refers to the formation of images in a broad sense that includes letters.

By the present invention, since the ejection heads are positioned so that the specific time difference nozzle pair position between a plurality of ejection heads does not overlap in the same row of the sub-scanning direction, the period of striping is shortened, and the striping becomes difficult to distinguish.

By another aspect of the present invention, the distance between nozzles in the main scanning direction whereby the droplet ejection time interval in the ejection head is longer is set to be smaller than the distance between other nozzles, whereby the width in which concentration decreases is narrowed, and striping becomes difficult to distinguish.

By yet another aspect of the present invention, the nozzles are arranged in overlapping fashion in line with the sub-scanning direction in positions that correspond to the specific time difference nozzle pair positions in the ejection head, and these plurality of nozzles arranged in overlapping fashion are driven and controlled so as to selectively eject, whereby it becomes possible to appropriately mix dots that are pulled towards the dots of the previous ejection with dots that are not drawn thereto. The number of portions in which the concentration decreases is thereby reduced, and the visibility of striping is reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
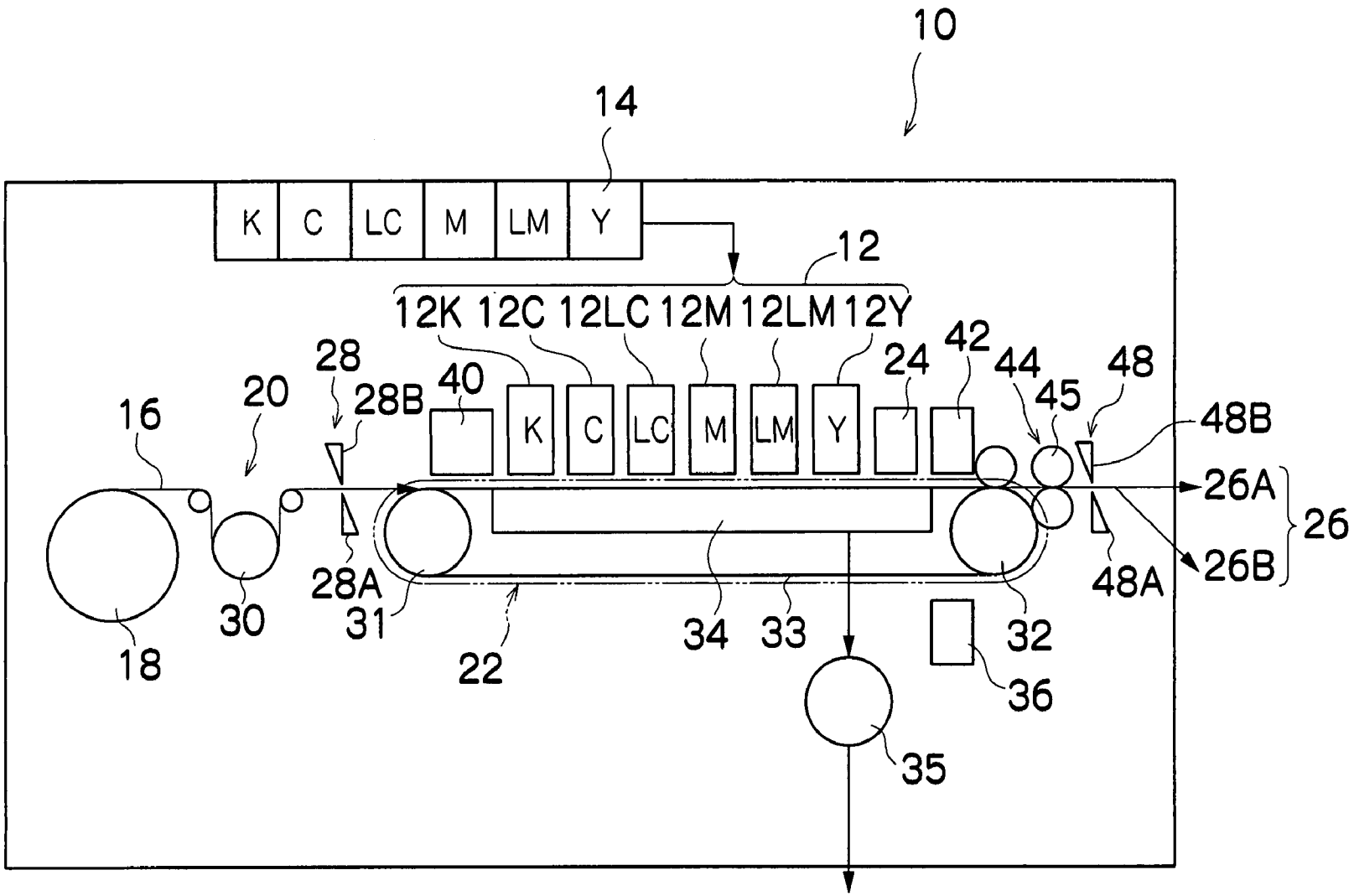
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12LC, 12M, 12LM, and 12Y for ink colors of black (K), cyan (C), light cyan (LC), magenta (M), light magenta (LM) and yellow (Y), respectively; an ink storing/loading unit 14 for storing inks to be supplied to the print heads 12K, 12C, 12LC, 12M, 12LM, and 12Y; a paper supply unit 18 for supplying recording paper 16; a decurling unit 20 for removing curl in the recording paper 16; a suction belt conveyance unit (corresponding to the conveyance device) 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing/loading unit 14 has tanks for storing the inks to be supplied to the print heads 12K, 12C, 12LC, 12M, 12LM, and 12Y, and the tanks are connected to the print heads 12K, 12C, 12LC, 12M, 12LM, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Each of the print heads 12K, 12C, 12LC, 12M, 12LM, and 12Y of the printing unit 12 is composed of a so-called full-line head having a length that corresponds to the maximum paper width intended for use in the inkjet recording apparatus 10, in which a plurality of ink-droplet ejection apertures (nozzles) are arranged along a length that exceeds at least one side of the maximum-size recording paper 16 (i.e. along the entire width of the printable area in the recording paper 16).

The print heads 12K, 12C, 12LC, 12M, 12LM, and 12Y are arranged in this order from the upstream side along the direction substantially perpendicular to the delivering direction of the recording paper 16 (hereinafter referred to as the paper conveyance direction). A color print can be formed on the recording paper 16 by ejecting the inks from the print heads 12K, 12C, 12LC, 12M, 12LM, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

In the present example, a six-color structure in which light cyan (LC) and light magenta (LM) are added to the standard colors (four colors) KCMY has been described, but the ink colors or combination of numbers of colors is not limited by the present embodiment. For example, a configuration is also possible in which other light inks or dark inks are added, and red, green, or other special colors of ink are added, and another possible configuration is one in which any of the ink colors are excluded. The number of heads is selected in relation to the number of colors used, but a single head may not necessarily be provided for a single color, and a plurality of heads may be provided which eject the same color of ink, or one head may have a nozzle row which ejects a different color of ink. The placement order of each head is also not subject to any particular limitation.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12LC, 12M, 12LM, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12LC, 12M, 12LM, and 12Y for the respective colors, and the ejection of each head is determined. The ejection determination includes the presence of the ejection, measurement of the dot size, and measurement of the dot deposition position. The details of the ejection determination are described later.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Structure of the Head

Next, the structure of the print heads is described. The print heads 12K, 12C, 12LC, 12M, 12LM, and 12Y provided for the ink colors have the same structure, and a reference numeral 50 is hereinafter designated to any of the print heads 12K, 12C, 12LC, 12M, 12LM, and 12Y.

Figure 2A:
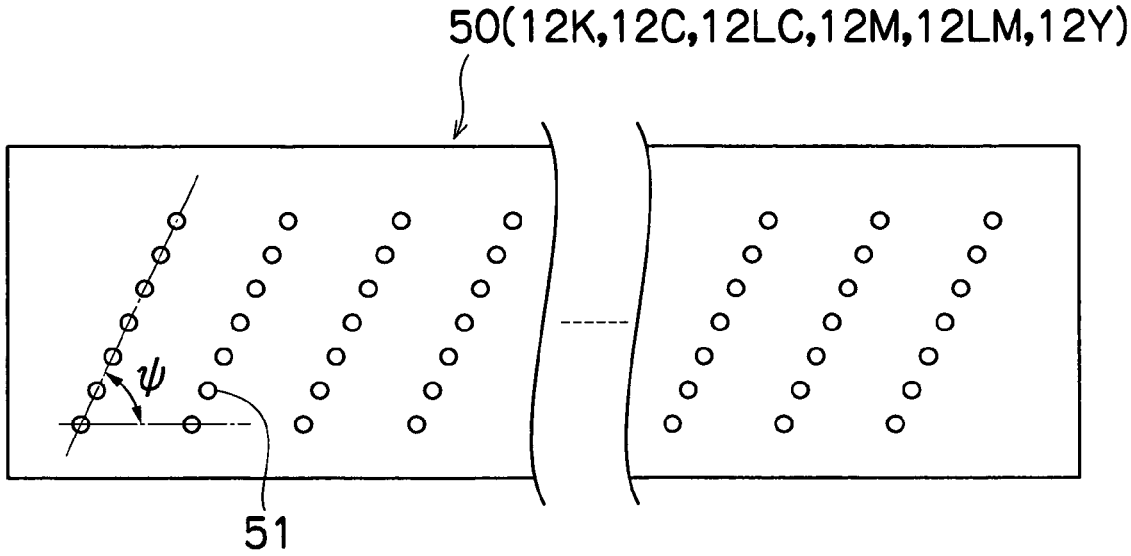
FIG. 2A is a perspective plan view showing an example of nozzle arrangement of the print head.
Figure 2B:
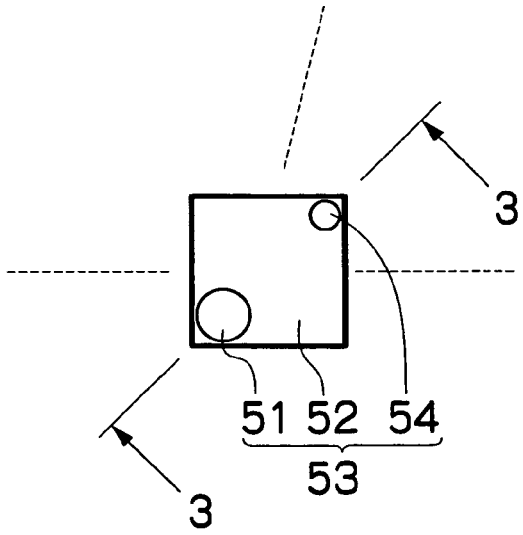
FIG. 2B is a perspective plan view showing another example of the showing nozzle arrangement of the print head.
Figure 3:
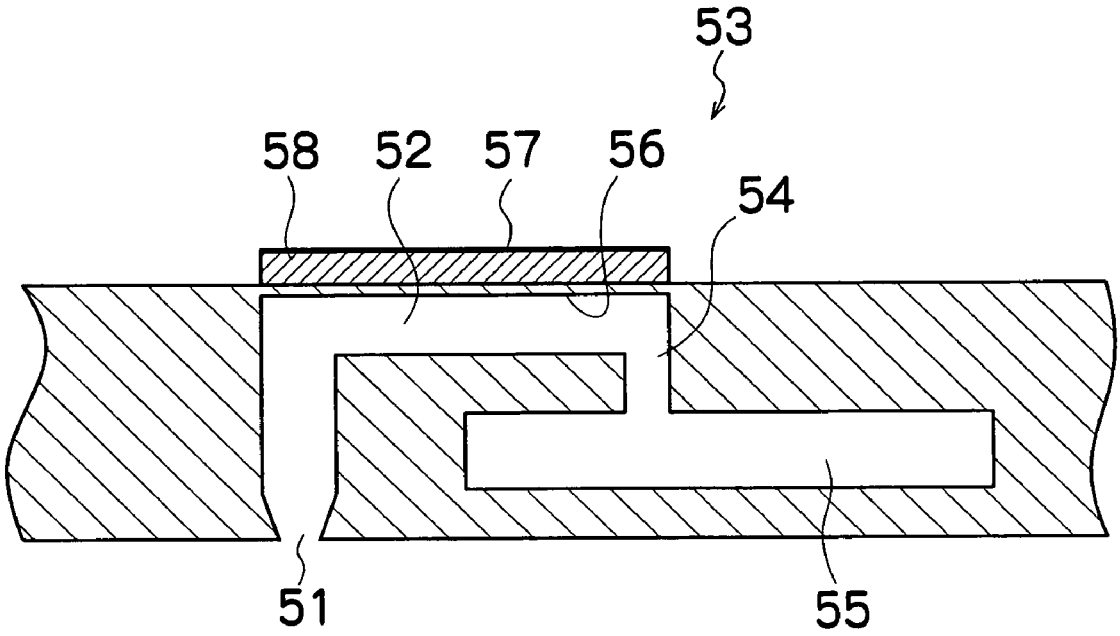
FIG. 3 is a cross-sectional view along a line 3-3 in FIG. 2B.

FIG. 2A is a perspective plan view showing an example of the configuration of the print head 50, FIG. 2B is an enlarged view of a portion thereof, and FIG. 3 is a cross-sectional view taken along the line 3-3 in FIG. 2B, showing the inner structure of an ink chamber unit.

As shown in FIG. 2A, the head 50 of the present example has a structure in which a plurality of nozzles 51 are arranged in a matrix at regular intervals along an oblique row direction having a certain angle ψ not perpendicular to the main scanning direction and the travel direction along the lengthwise direction (the direction perpendicular to the paper conveyance direction; the main scanning direction) of the head. A schematic view thereof is shown in the figure, but by this structure, it becomes possible to achieve a high-density nozzle structure in which the nozzle rows projected so as to line up in the main scanning direction have up to 2,400 nozzles in one inch (2,400 nozzles/inch) thereof.

The nozzle placement of the head 50 shown in FIG. 2A is obtained by a configuration in which the ink chamber units 53 made up of the nozzles 51, which are ink droplet ejection ports, and the pressure chambers 52 corresponding to the nozzles 51 are arranged two-dimensionally in a matrix, as shown in FIG. 2B. The reference numeral 54 indicates the supply port which supplied ink to the pressure chamber 52.

The planar shape of the pressure chamber 52 provided for each nozzle 51 is substantially a square, and an outlet to the nozzle 51 and an inlet for supplied ink (supply port) 54 are disposed in both corners on a diagonal line of the square. The shape of the pressure chamber 52 is not limited to the present example, and the planar shape may one of various shapes, such as a quadrilateral shape (diamond, rectangle, or the like), another polygonal shape, such as a pentagon or hexagon, or a circular or elliptical shape.

As shown in FIG. 3, each pressure chamber 52 is connected to a common channel 55 through the supply port 54. The common channel 55 is connected to an ink tank 60 (not shown in FIG. 3, but shown in FIG. 4), which is a base tank that supplies ink, and the ink supplied from the ink tank 60 is delivered through the common flow channel 55 to the pressure chambers 52.

An actuator 58 provided with an individual electrode 57 is bonded to a pressure plate (diaphragm) 56, which forms a part (the upper face in FIG. 3) of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

In the implementation of the present invention, the structure of the nozzle arrangement is not particularly limited to the examples shown in the drawings. Moreover, the present embodiment adopts the structure that ejects ink-droplets by deforming the actuator 58 such as a piezoelectric element; however, the implementation of the present invention is not particularly limited to this. Instead of the piezoelectric inkjet method, various methods may be adopted including a thermal inkjet method in which ink is heated by a heater or another heat source to generate bubbles, and ink-droplets are ejected by the pressure thereof.

Configuration of Ink Supply System

Figure 4:
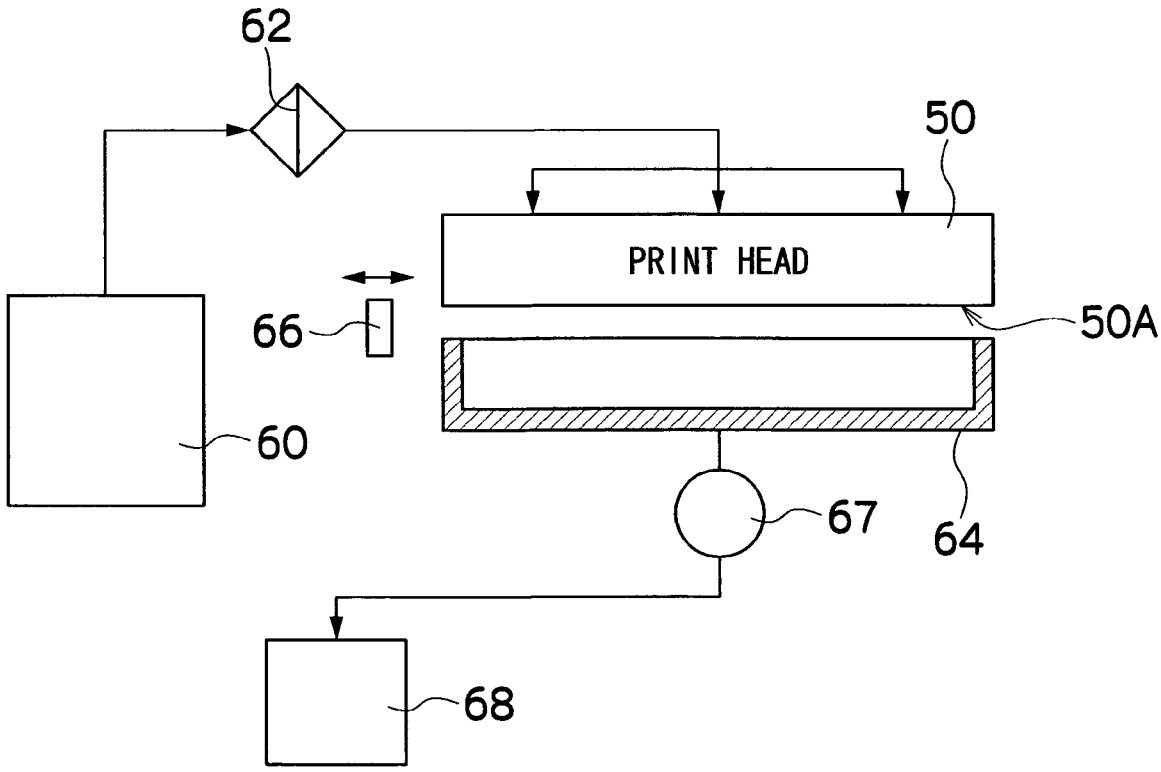
FIG. 4 is a schematic drawing showing a configuration of an ink supply system in the inkjet recording apparatus.

FIG. 4 is a schematic drawing showing the configuration of the ink supply system in the inkjet recording apparatus 10. The ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform droplet ejection control in accordance with the ink type. The ink supply tank 60 in FIG. 4 is equivalent to the ink storing/loading unit 14 in FIG. 1 described above.

A filter 62 for removing foreign matters and bubbles is disposed between the ink supply tank 60 and the print head 50, as shown in FIG. 4. The filter mesh size in the filter 62 is preferably equivalent to or less than the diameter of the nozzle and commonly about 20 μm. Although not shown in FIG. 4, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face 50A is thereby covered with the cap 64.

The cleaning blade 66 is composed of rubber or another elastic member, and can slide on the ink ejection surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 66 on the nozzle plate.

During printing or standby, when the frequency of use of specific nozzles is reduced and ink viscosity increases in the vicinity of the nozzles, a preliminary ejection is made toward the cap 64 to eject the degraded ink.

Also, when bubbles have become intermixed in the ink inside the print head 50 (inside the pressure chamber 52), the cap 64 is placed on the print head 50, ink (ink in which bubbles have become intermixed) inside the pressure chamber 52 is removed by suction with a suction pump 67, and the suction-removed ink is sent to a collection tank 68. This suction action entails the suctioning of degraded ink of which viscosity has increased (hardened) when initially loaded into the head, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state the actuator 58 is operated (in a viscosity range that allows ejection by the operation of the actuator 58), and the preliminary ejection is made toward the ink receptor to which the ink of which viscosity has increased in the vicinity of the nozzle is to be ejected. After the nozzle surface 50A is cleaned by a wiper such as the cleaning blade 66 provided as the cleaning device for the nozzle face, a preliminary ejection is also carried out in order to prevent the foreign matter from becoming mixed inside the nozzles 51 by the wiper sliding operation. The preliminary ejection is also referred to as "dummy ejection", "purge", "liquid ejection", and so on.

When bubbles have become intermixed in the nozzle 51 or the pressure chamber 52, or when the ink viscosity inside the nozzle 51 has increased over a certain level, ink can no longer be ejected by the preliminary ejection, and a suctioning action is carried out as follows.

More specifically, when bubbles have become intermixed in the ink inside the nozzle 51 and the pressure chamber 52, ink can no longer be ejected from the nozzles even if the actuator 58 is operated. Also, when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face of the print head 50, and the ink in which bubbles have become intermixed or the ink of which viscosity has increased is removed by suction.

However, this suction action is performed with respect to all the ink in the pressure chamber 52, so that the amount of ink consumption is considerable. Therefore, a preferred aspect is one in which a preliminary ejection is performed when the increase in the viscosity of the ink is small.

Description of Control System

Figure 5:
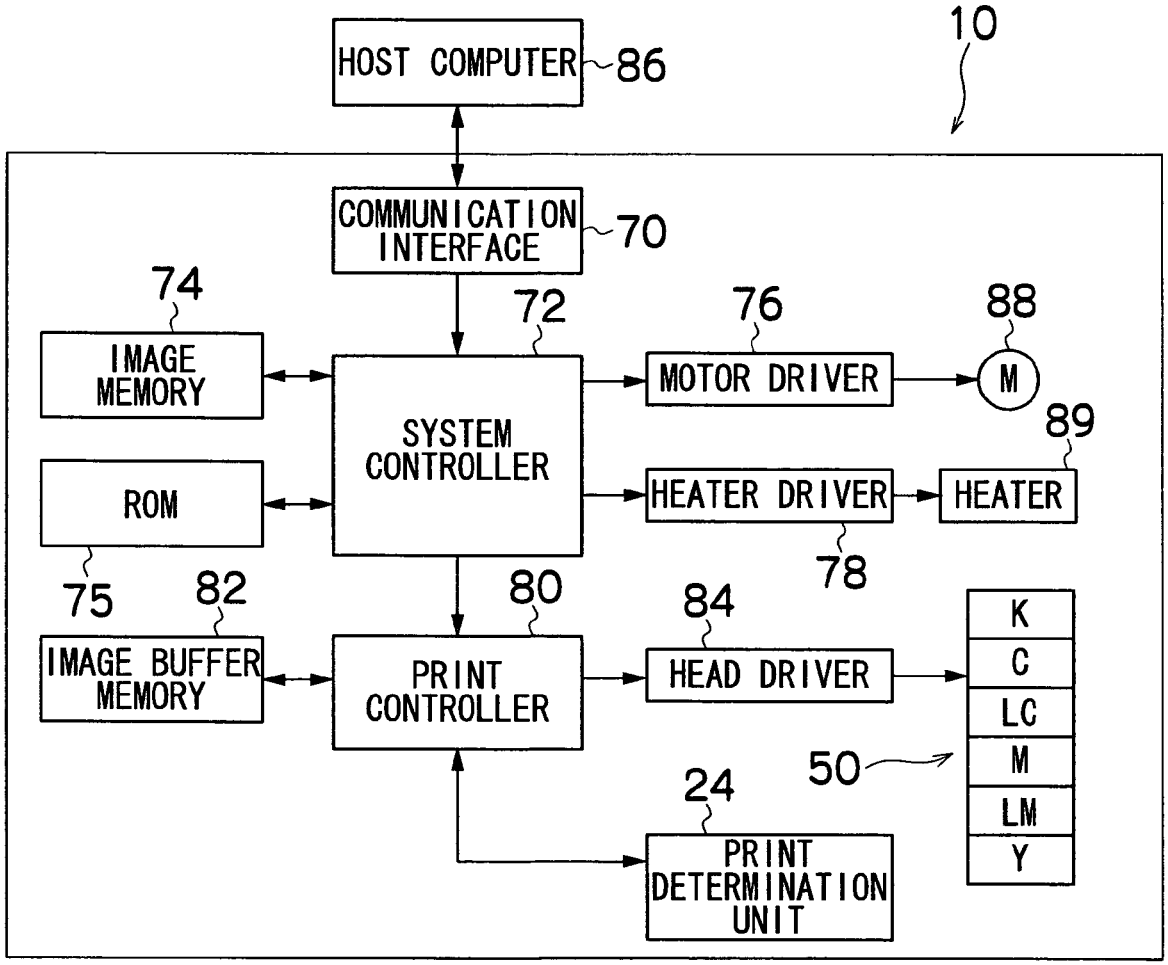
FIG. 5 is a principal block diagram showing the system composition of the inkjet recording apparatus.

FIG. 5 is a block diagram of the principal components showing the system configuration of the inkjet recording apparatus 10. The inkjet recording apparatus 10 has a communication interface 70, a system controller 72, an image memory 74, ROM 75, a motor driver 76, a heater driver 78, a print controller 80, an image buffer memory 82, a history information storing unit 83, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 functions as a control device for controlling the whole inkjet recording apparatus 10 in accordance with a prescribed program, and it also functions as a calculating device for performing various types of calculations. More specifically, the system controller 72 is constituted by a central processing unit (CPU), peripheral circuits relating to same, and the like. The system controller 72 controls respective units, such as the communications interface 70, image memory 74, ROM 75, motor driver 76, and the like, and it also controls communications with the host computer 86 and read and write operations to and from the image memory 74, ROM 75, and the like, as well as generating control signals for controlling the conveyance motor 88 and the heater 89.

The ROM 75 stores programs executed by the CPU of the system controller 72, various data required for control procedures, and the like. It is preferable that the ROM 75 is a non-rewriteable storage device, or a rewriteable storage device such as an EEPROM. The image memory 74 is used as a temporary storage region for image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. In other words, the print control unit 80 functions as a "discharge controller", including the system controller 72. Prescribed signal processing is carried out in the print control unit 80, and the ejection amount and the ejection timing of the ink droplets from the respective print heads 50 are controlled via the head drier 84, on the basis of the image data. By this means, prescribed dot size and dot positions can be achieved.

Figure 8:
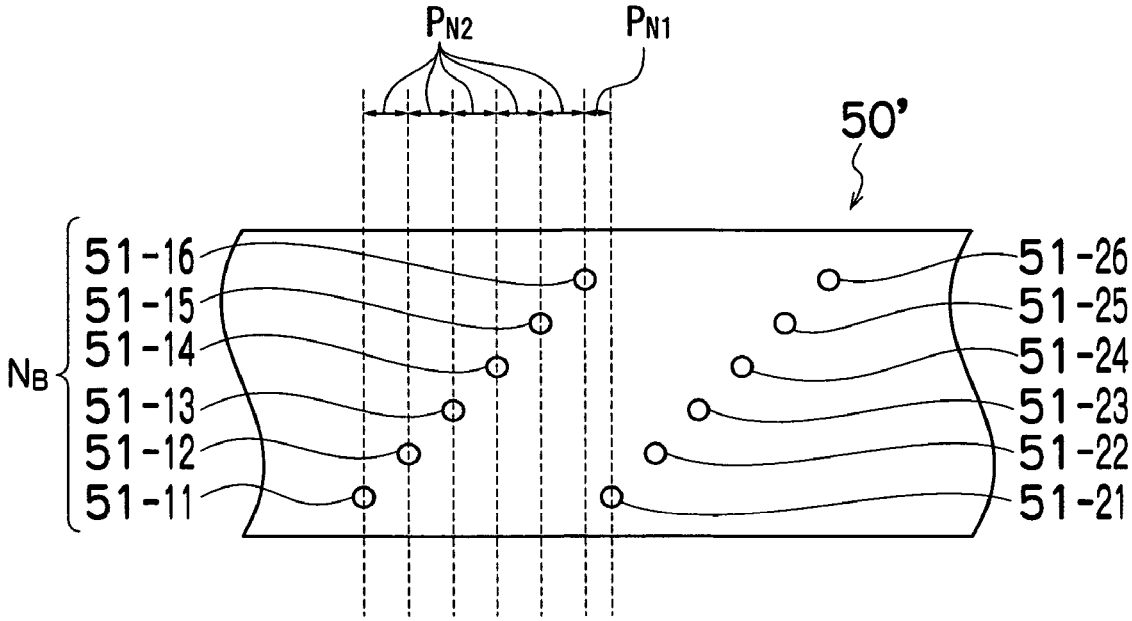
FIG. 8 is a schematic plan drawing of a head according to another embodiment of the present invention.

The print controller 80 is provided with the image buffer memory 82; and image data, parameters, and other data are temporarily stored in the image buffer memory 82 when image data is processed in the print controller 80. The aspect shown in FIG. 8 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 (corresponding to the ejection drive device) for the head 50 of each color on the basis of the print data received from the print controller 80. A feedback control system for keeping the drive conditions for the print heads constant may be included in the head driver 84.

The image data to be printed is externally inputted via the communication interface 70, and is stored in the image memory 74. At this stage, the RGB image data are stored in the image memory 74.

The image data stored in the image memory 74 are sent to the print controller 80 via the system controller 72 and converted into dot data for each ink color in the print controller 80. Specifically, the print controller 80 performs processing which converts the inputted RGB image data into dot data for the six colors K, C, LC, M, LM, and Y. The dot data generated by the print controller 80 are stored in the image buffer memory 82.

The head driver 84 generates a drive control signal for the print head 50 based on the dot data stored in the image buffer memory 82. The drive control signal generated by the head driver 84 is applied to the head 50, whereby the ink is ejected from the head 50. Ink ejection from the head 50 is controlled in synchrony with the conveying velocity of the recording paper 16, whereby an image is formed on the recording paper 16.

As shown in FIG. 1, the print determination unit 24 is a block containing a line sensor, which reads the image printed on the recording paper 16, performs the necessary signal processing and the like, detects the printing status (whether ejection is being performed, the presence of fluctuation in droplet ejection, and the like), and presents the determination results to the print controller 80.

The print controller 80 performs various types of correction for the head 50 as needed based on information obtained from the print determination unit 24. The system controller 72 performs control which performs preliminary ejection, suction, or other prescribed repeated actions based on information obtained from the droplet ejection determination unit 24.

Positioning Structure of Color-Specific Heads in the Print Unit

In order to reduce the visibility of the striping described in FIGS. 11 to 13C, the heads in the inkjet recording apparatus 10 of the present example are arranged so that the phases of the spatial repetition cycles of the boundary portions of the nozzle blocks are displaced, so that the boundary portions (zigzag portions of the nozzle rows) of the nozzle blocks corresponding to the "specific time difference nozzle pair positions" between the plurality of heads do not line up in the same line of the paper conveyance direction. Since the distance between heads (distance in the paper conveyance direction) is adequately long compare to the distance between dots, the effects of droplet ejection interference between heads are small.

First Example of Head Arrangement

Figure 6:
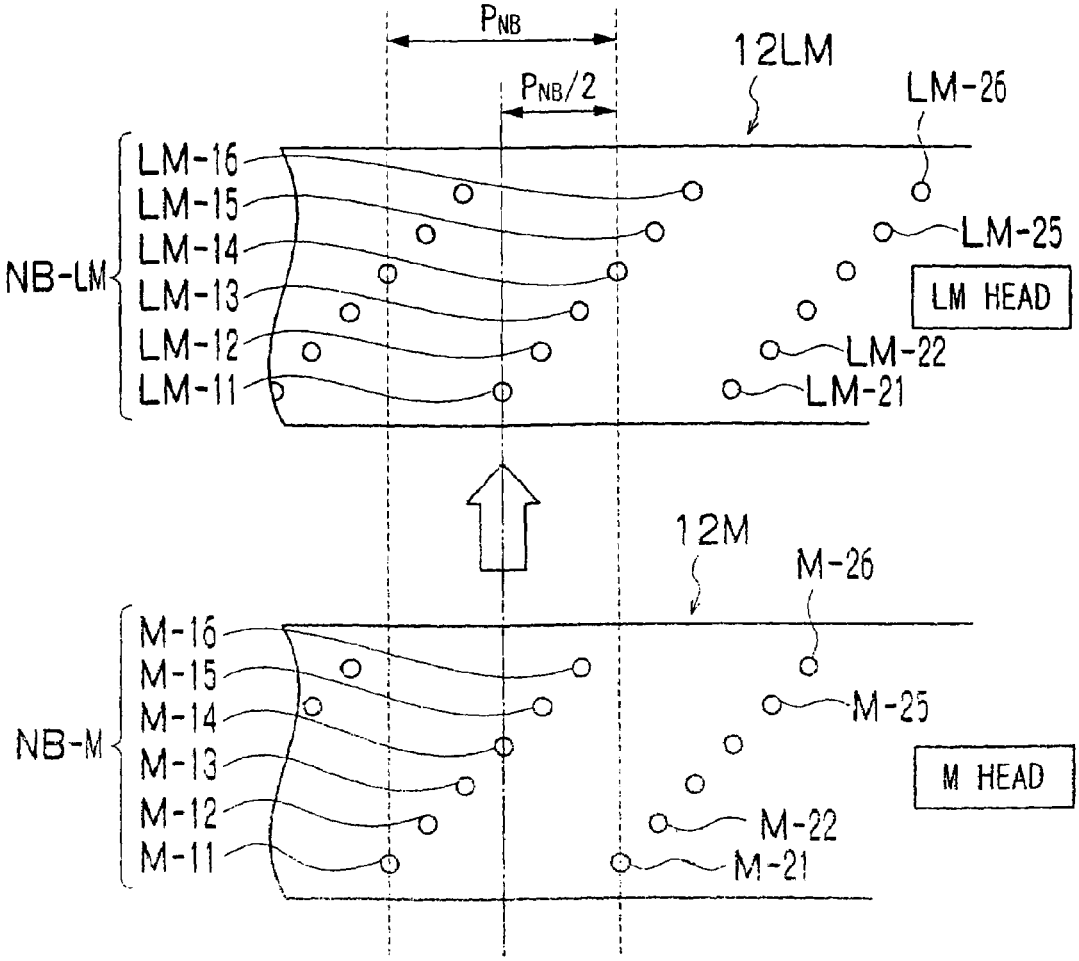
FIG. 6 is a schematic plan drawing showing the arrangement relation of two heads according to the first example of head arrangement.

FIG. 6 is a schematic plan drawing showing an example of the arrangement relation of two heads. The recording medium (not shown in FIG. 6) is conveyed from bottom to top in FIG. 6. In FIG. 6, the arrangement relation between the magenta head 12M and the light magenta head 12LM is shown.

In FIG. 6, the boundary portion of nozzle block NB-M (nozzles M-ij, wherein i is an integer, and j=1, 2, . . . , 6) in the row direction in the magenta head 12M, specifically, in the nozzle space between nozzle M-16 and nozzle M-21, the droplet ejection time difference becomes longer than in other nozzle spaces (for example, that of nozzle M-11 and M-12, and others). The position in which a pair of nozzles (M-16, M-21) is present having this type of positional relation corresponds to the "specific time difference nozzle pair position." As shown in FIG. 6, an arrangement relation is adopted whereby the phase of the repetition cycle (PNB) of nozzle block NB-M (nozzles M-ij; i is an integer, and j=1, 2, . . . , 6) in the row direction in the magenta head 12M and the phase of the repetition cycle of nozzle block NB-LM (nozzles LM-ij; i is an integer, and j=1, 2, . . . , 6) in the row direction in the light magenta head 12LM are displaced by ½ cycle from each other.

By this type of arrangement relation, during droplet ejection by the heads 12M and 12 LM individually, striping occurs in a repetition cycle (PNB) that corresponds to the cycles of nozzle blocks NB-M and NB-LM, but in terms of the results of droplet ejection by the combination of these two heads 12M and 12 LM, the striping cycle becomes ½ the repetition cycle (PNB) of the nozzle blocks. The frequency of striping is thus increased, whereby the striping becomes more difficult to distinguish. Since the amplitude of striping also decreases due to displacement of the repetition cycle phases, the striping becomes even more difficult to distinguish.

As is commonly known, the visual characteristics (VTF) of the human eye are such that response is high in areas of comparatively low spatial frequency, and response decreases in areas of high frequency. Therefore, striping is almost invisible if the spatial frequency of the striping is increased to the degree that discrimination thereof is difficult given the visual characteristics of the human eye.

The nozzle blocks NB-M and NB-LM are preferably composed of blocks of even numbers (particularly 4 and above) of nozzles, as in the present example. It thereby becomes possible to arrange different-colored nozzles along the same line in the sub-scanning direction between the heads 12M and 12 LM whose phases are displaced by ½, and it becomes possible for dots to be deposited in the same row in the sub-scanning direction (dots of different colors can be stacked in the same position on the recording medium).

Specifically, as shown in FIG. 6, by setting the number of nozzles to 6 (an even number) in each single nozzle block of the LM head (12LM) and the M head (12M), and setting the phases of the LM head and M head to ½ pitch (which corresponds to a pitch of three nozzles), it becomes possible to arrange LM nozzles and M nozzles along the same line in the sub-scanning direction, and a droplet ejection arrangement can be obtained that can easily produce high image quality.

In FIG. 6, the magenta head 12M and the light magenta head 12LM have been described, but the combination of colors is not particularly limited, and the same arrangement relation can be configured for a plurality of heads without regard to the color or order of arrangement thereof. However, a preferred aspect is one in which the type of arrangement relation shown in FIG. 6 is set between a plurality of heads which eject dark and light ink of the same color, a plurality of heads which eject ink of the same hue, or a plurality of heads which eject different-colored ink of a similar hue (a nearly identical hue). By creating this arrangement relation in which the phases are displaced between heads for dark and light ink or other same-hued or similar-hued ink, the visibility of striping can be reduced not only in secondary colors or gray, but also in the hue of the ink color material.

Second Example of Head Arrangement

Figure 7:
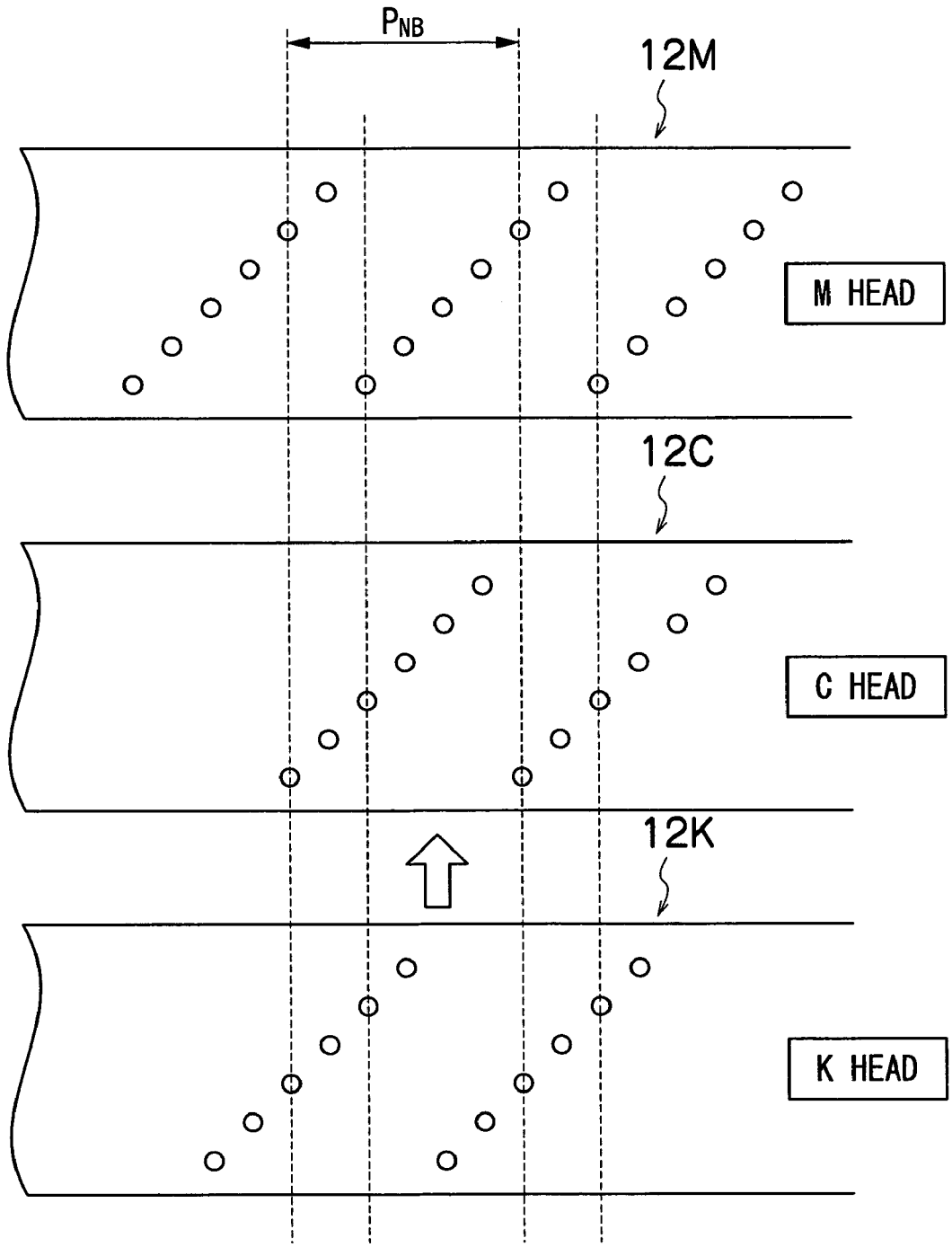
FIG. 7 is a schematic plan drawing showing the arrangement relation of three heads according to the second example of head arrangement.

FIG. 7 is a schematic plan view showing another embodiment of the present invention. The recording medium (not shown in FIG. 7) is conveyed from bottom to top in FIG. 7. In FIG. 7, the phases of the repetition cycles (PNB) of the nozzle blocks between the three heads 12K, 12C, and 12M are displaced by ⅓, the repetition frequency of the striping is increased by a factor of 3, and the visibility thereof is reduced.

This structure can be applied to the structure of a print unit from which the light cyan head 12LC and light magenta head 12LM described in FIG. 1 are omitted. Since a difference in brightness is difficult to distinguish with yellow ink, the phases of the heads for the three colors other than yellow (K, C, M) are preferably displaced by ⅓ in the case of a KCMY four-color configuration. In this case as well, by configuring the nozzle blocks arranged in the oblique row direction using an even number of nozzles, it becomes possible to deposit dots on the same row in the sub-scanning direction between heads whose phases are displaced by ⅓ (dots of different colors can be stacked in the same position on the recording medium). By this head arrangement relation, the visibility of striping can be reduced particularly for secondary colors or gray.

Design by Head Structure

Another embodiment of the present invention will next be described. In FIGS. 6 and 7 described above, the frequency of striping is increased, and the visibility thereof is minimized by designing the arrangement relation between a plurality of heads. In lieu of this method, or by combining this method with a method whereby the structure of the head itself or the droplet ejection is designed as described below, the visibility of striping can be minimized or further reduced.

FIG. 8 is a schematic plan view of the head according to another embodiment of the present invention. The recording medium (not shown in FIG. 8) is conveyed from bottom to top in FIG. 8.

The head 50' shown in FIG. 8 is configured so that the pitch between nozzles PN1 (the interval between essentially adjacent nozzles which deposit adjacent dots in the main scanning direction) of the boundary portions of the nozzle block NB (nozzles 51-*ij*; i is an integer, and j=1, 2, . . . , 6) is set so as to be narrower than the pitch PN2 between other nozzles.

In other words, the distance in the main scanning direction between nozzles (the pitch between nozzles in the main scanning direction) whereby the droplet ejection time interval between adjacent dots along the main scanning direction is longer than that of others is made shorter than the pitch between other nozzles.

Figure 9A:
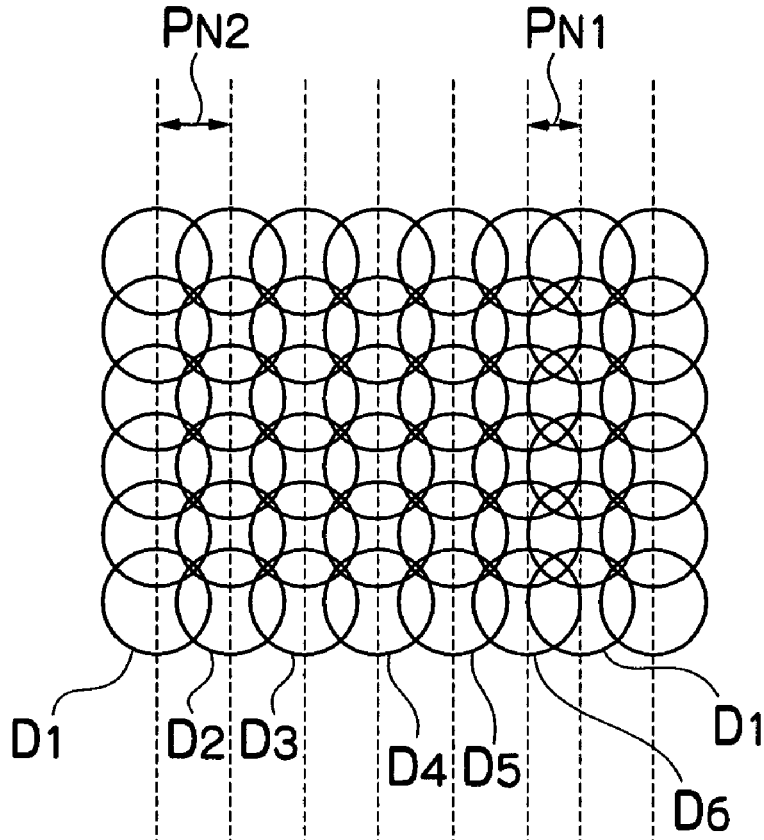
FIGS. 9A and 9B are schematic drawings showing the results of droplet ejection by the head shown in FIG. 8.
Figure 9B:
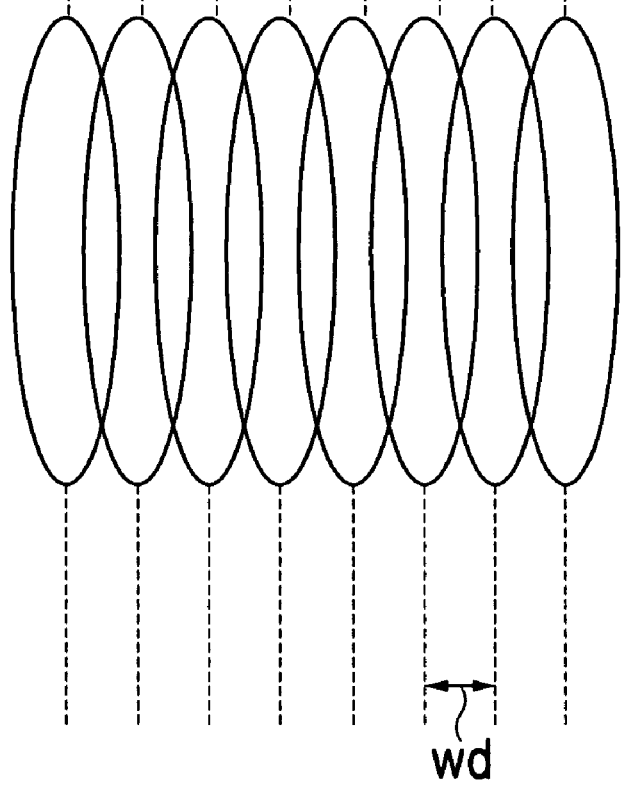

In the head 50' having this type of nozzle arrangement, when sequential ejection driving (main scanning) from the nozzle (nozzle 51-*i*1; i is an integer) at one end of the nozzle block NB the nozzle (nozzle 51-*i*6; i is an integer) at the other end thereof is performed, a dot placement such as the one shown in FIGS. 9A and 9B is obtained.

FIG. 9A shows the dot placement (the target positions for controlled droplet ejection) immediately after droplet ejection, and FIG. 9B is a schematic view of the results of dot aggregation.

The dots Dj (wherein j=2 to 6) deposited by the nozzles 51-*ij* (wherein i is an integer, and j=2 to 6) depicted in FIG. 8 are each pulled towards and coalesce with the landed dots Dj-1 (wherein j =2 to 6) immediately to the left thereof, but since the nozzle 51-*i*1 (wherein i is an integer) is the first to be driven in the nozzle block NB, the dot D1 deposited by this nozzle 51-*i*1 (wherein i is an integer) is ejected prior to the dot D6 immediately to the left thereof, and the fixation thereof is further advanced.

Specifically, the droplet ejection time difference between the dot D1 and the dot D6 immediately to the left thereof is longer than the droplet ejection time difference between other dots, and the dot D1 is not pulled towards the left. In the present example, since the pitch PN1 between the two nozzles having this longer droplet ejection time difference is narrower than the pitch PN2 between other nozzles, the width wd wherein uneven concentration occurs is reduced, and striping becomes difficult to distinguish compared to a case in which all of the pitches between nozzles are set to the same interval as PN2. By setting a pitch PN1 between nozzles that is appropriate considering the type of recording medium, the characteristics of the ink, the droplet ejection time difference, and other factors, it also becomes possible to minimize the occurrence of striping.

The method whereby the dot placement shown in FIG. 9A is obtained is not limited to an aspect which uses a head 50' having a nozzle arrangement such as the one shown in FIG. 8. For example, it is also possible to provide a device which deflects flying liquid droplets, a device which controls the direction in which liquid droplets are ejected, or the like which effectively arranges the landing positions of liquid droplets on the recording medium in the type of arrangement shown in FIG. 9A.

Figure 10A:
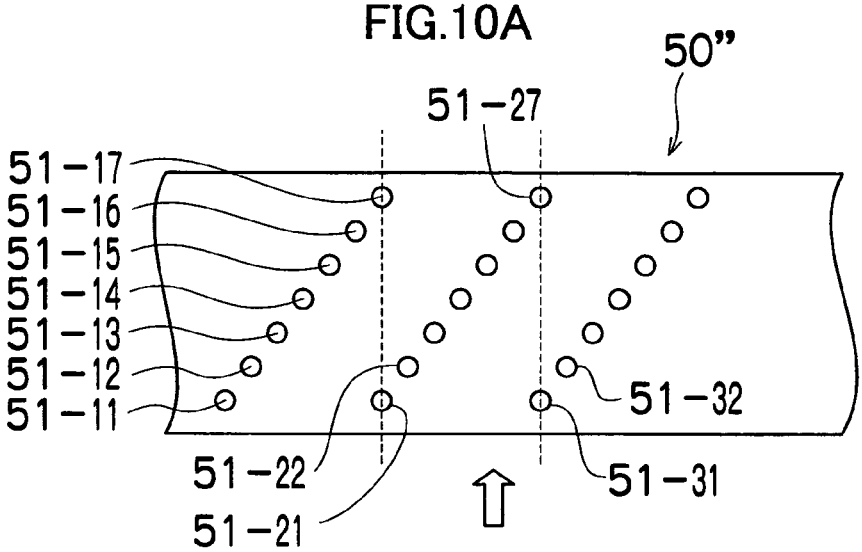
FIG. 10A is a schematic plan drawing of the head according to another embodiment of the present invention.

FIG. 10A is a schematic plan view of the head according to another embodiment of the present invention. The recording medium (not shown in FIG. 10A) is conveyed from bottom to top in FIG. 10A.

In the head 50" shown in FIG. 10A, the nozzle 51-*k*7 (wherein k=i−1) whose ejection time is the last is arranged on the sub-scanning direction line of the nozzle 51-*i*1 (wherein i is an integer) whose ejection time is first. Droplet ejection control is thus performed so as to selectively divide the usage of the nozzles 51-*i*1 and 51-*k*7 arranged in overlapping fashion on the same sub-scanning direction line.

For example, possible aspects include an aspect which switches the ejection of these two nozzles 51-*i*1 and 51-*k*7 at random, an aspect which uses these nozzles in alternating fashion, and other aspects.

Figure 10B:
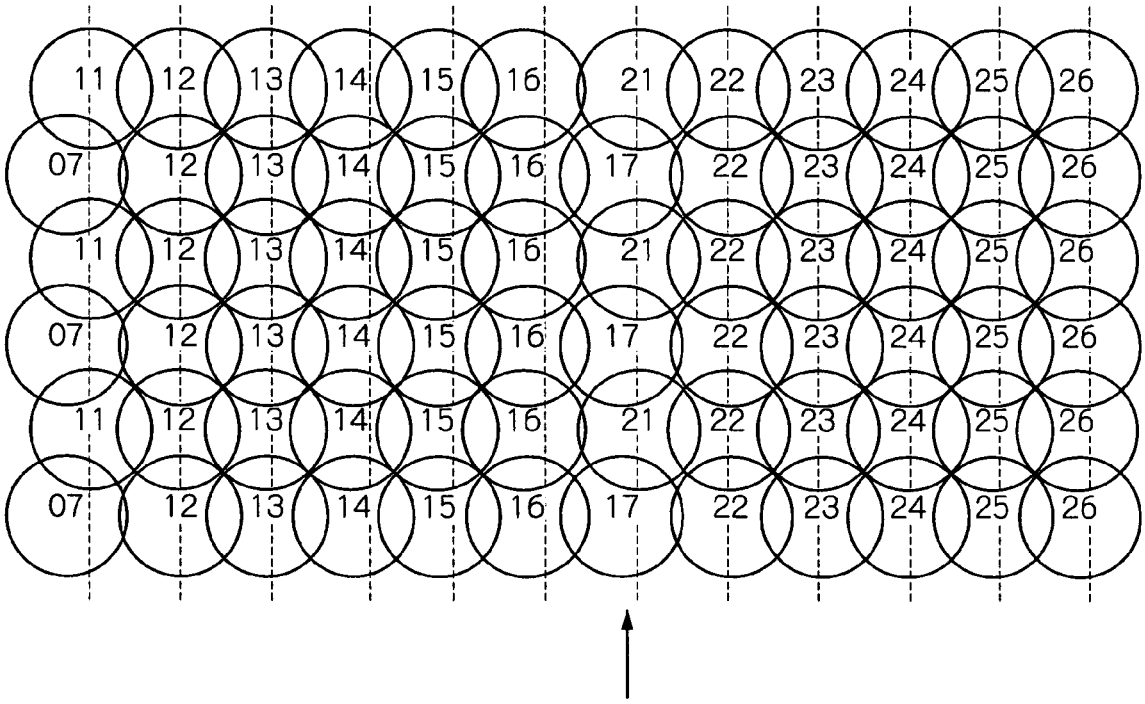
FIG. 10B is a schematic drawing showing the results of droplet ejection obtained by selectively driving the plurality of nozzles in alternating fashion arranged so as to overlap on the same line in the sub-scanning direction.
Figure 11:
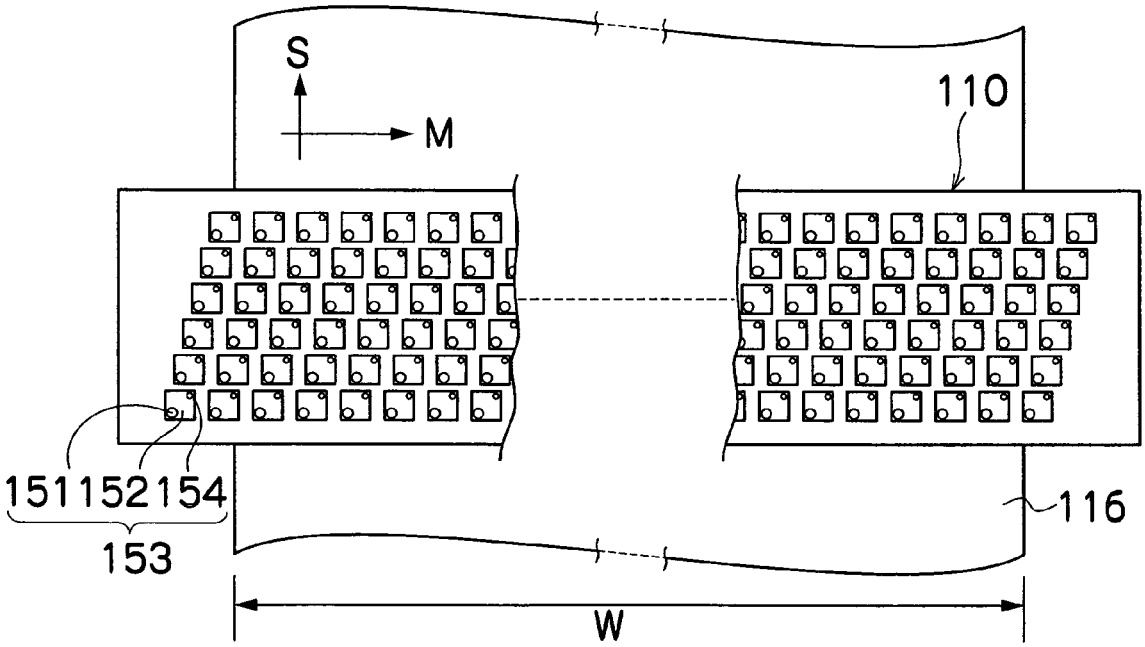
FIG. 11 is a perspective plan drawing of a full-line head provided with nozzles lined up in two dimensions at high density.
Figure 12:
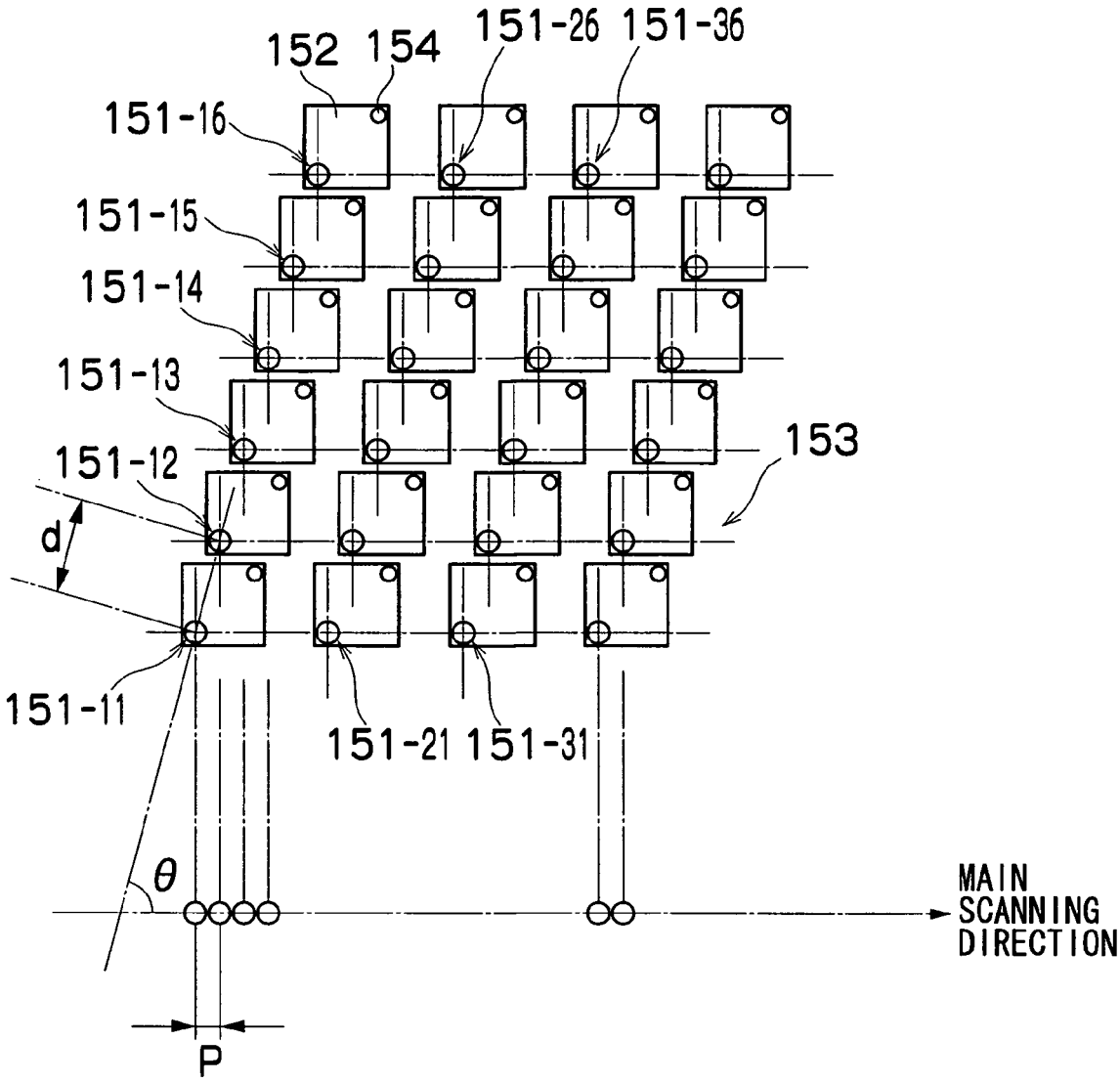
FIG. 12 is a partial magnified view showing the nozzle arrangement of the head shown in FIG. 11.
Figures 13A, 13B, 13C:
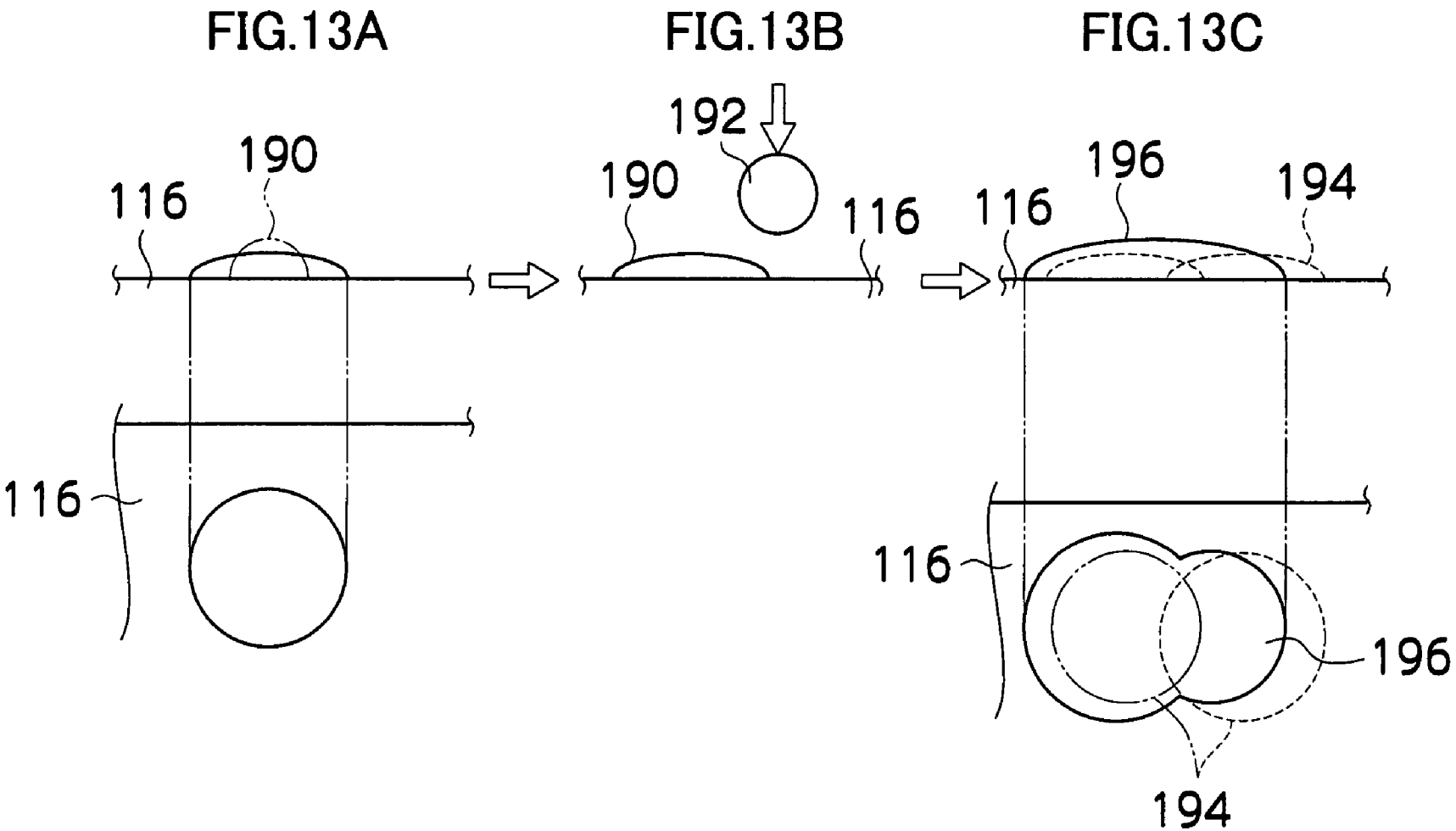
FIGS. 13A to 13C are diagrams used for describing the cause of striping that occurs due to aggregation between adjacent dots.
Figure 14A:
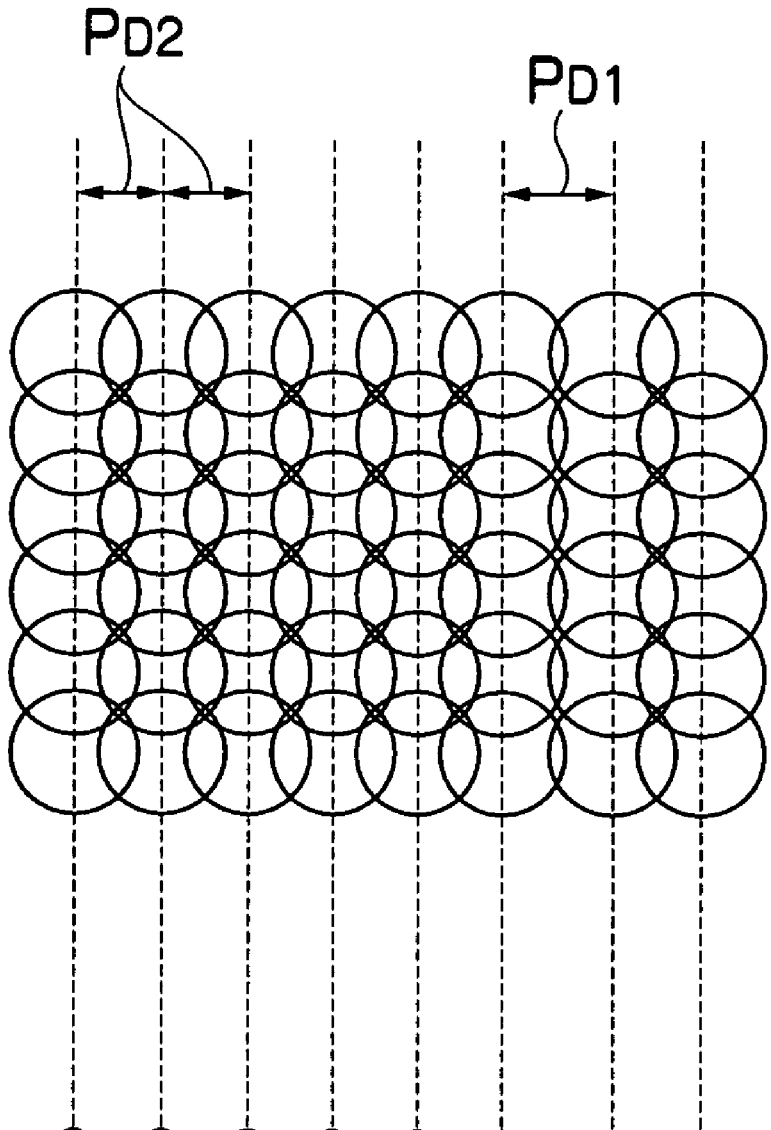
FIGS. 14A and 14B are schematic drawings showing the results of droplet ejection by the head shown in FIG. 11.
Figure 14B:
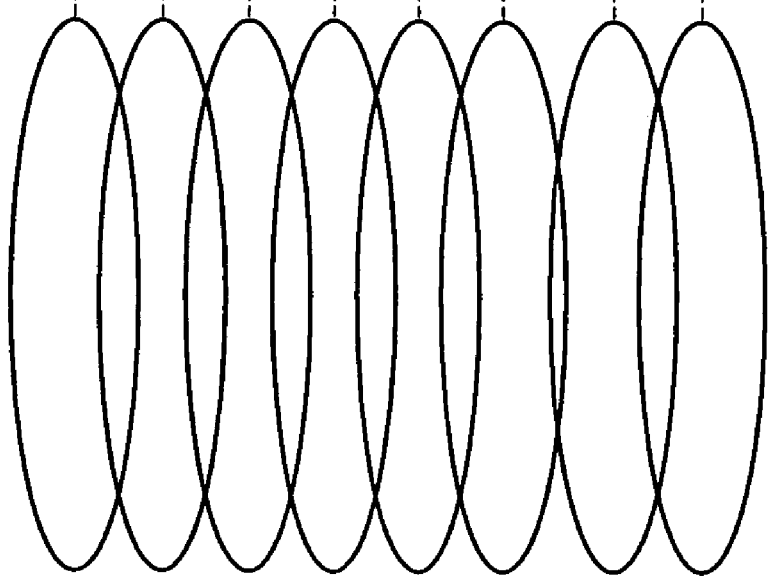

The liquid droplet deposited by the nozzle 51-*k*7 is pulled toward the liquid droplet ejected by the nozzle 51-*k*6 immediately to the left thereof and moves to the left, and the liquid droplet deposited by the nozzle 51-*i*1 does not move to the left. FIG. 10B shows a schematic view of the results of droplet ejection when the nozzles 51-*i*1 and 51-*k*7 are alternately selected. In FIG. 10B, i=2 and k=1, and the "51-" is omitted from the numbers in the droplet ejection circles. Since nozzles 51-17 and 51-21 are alternately selected, striping is difficult to distinguish in the portion indicated by the arrow in FIG. 10B. The dots which move to the left on the same line in the sub-scanning direction are thus appropriately mixed with dots which do not move to the left, whereby the number of portions in which the concentration decreases is thereby reduced, and the visibility of striping is reduced.

The "specific time difference nozzle pair position" when the nozzle 51-17 shown in FIG. 10A is used becomes the nozzle interval between "51-17" and "51-22," and the "specific time difference nozzle pair position" when the nozzle 51-21 is used becomes the nozzle interval between "51-16" and "51-21". When the phase of the specific time difference nozzle pair positions between a plurality of heads is in a displaced arrangement as depicted in FIGS. 6 and 7 using the head 50' in which the "specific time difference nozzle pair position" changes according to the nozzle selected for use, a more effective configuration is one whereby the amount of phase shift between heads is larger than the amount of variance in the "specific time difference nozzle pair position" within the head.

An inkjet recording apparatus is described as an example of the image forming apparatus in the above description, but the range of application of the present invention is not limited to this example. For example, the liquid droplet ejection apparatus of the present invention may also be applied to a photographic image forming apparatus or the like which applies a developing fluid to printing paper without coming in contact with the printing paper. The range of application of the liquid droplet ejection apparatus of the present invention is also not limited to an image forming apparatus, and the present invention may also be applied to various types of apparatuses (coating apparatuses, application apparatuses, and the like) which eject treatment fluids and various other types of fluid towards a printed medium using an ejection head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet ejection apparatus, comprising:

a plurality of ejection heads having an ejection surface in which nozzles for ejecting droplets of liquid towards an ejection receiving medium are arranged two-dimensionally;

a conveying device which conveys at least one of the ejection heads and the ejection receiving medium in a fixed direction to cause relative movement of the ejection heads and the ejection receiving medium in a relative movement direction; and a droplet ejection control device which performs droplet ejection control whereby droplets of the liquid are ejected from the ejection heads towards the ejection receiving medium together with the relative movement caused by the conveying device, and a row of dots is formed by the droplets of the liquid landing on the ejection receiving medium in which at least some of the dots overlap in a main scanning direction substantially perpendicular to the relative movement direction, wherein when a position between nozzles at which a droplet ejection time difference between adjacent dots in the main scanning direction in one ejection head differs from a droplet ejection time difference between other adjacent dots is referred to as a specific time difference nozzle pair position in a corresponding ejection head, the ejection head is positioned so that the specific time difference nozzle pair position differs in the main scanning direction between at least two of the ejection heads.

2. The liquid droplet ejection apparatus defined in claim 1, wherein a spatial repetition cycle of the specific time difference nozzle pair position in the main scanning direction in the ejection heads is shared, and the ejection heads are arranged so that a phase of the repetition cycle between n (wherein n is an integer not less than 2) ejection heads is displaced by substantially 1/n.

3. The liquid droplet ejection apparatus defined in claim 1, wherein the ejection heads are full-line heads formed by two-dimensionally arranged nozzle groups extending all along a length that corresponds to an entire width of the ejection receiving medium.

4. The liquid droplet ejection apparatus as defined in claim 1, wherein:

the nozzles are arranged in a matrix along a column direction substantially perpendicular to the relative movement direction and in an oblique row direction having a certain angle with respect to the column direction; and each block of nozzle rows along the column direction is driven in sequence from the nozzle on one end of each block to the nozzle on the other end thereof, whereby a row of dots is formed along the main scanning direction.

5. The liquid droplet ejection apparatus as defined in claim 4, wherein the specific time difference nozzle pair positions correspond to boundary portions of the blocks in the nozzle row.

6. The liquid droplet ejection apparatus as defined in claim 4, wherein the blocks in the nozzle rows are composed of an even number of nozzles.

7. The liquid droplet ejection apparatus as defined in claim 1, wherein the plurality of ejection heads comprise two ejection heads which each ejects at least two colors of ink from among cyan (C), magenta (M), and black (K).

8. The liquid droplet ejection apparatus as defined in claim 1, wherein the at least two ejection heads which place the specific time difference nozzle pair positions so as to differ in the main scanning direction comprise two ejection heads which eject ink having the same hue.

9. The liquid droplet ejection apparatus as defined in claim 1, wherein the at least two ejection heads which place the specific time difference nozzle pair positions so as to differ in the main scanning direction comprise two ejection heads which eject dark ink and light ink, respectively, composed of a same dye.

10. The liquid droplet ejection apparatus as defined in claim 1, wherein the ejection head has a nozzle arrangement structure whereby the distance in the main scanning direction between nozzles, whereby the ejection time difference between adjacent dots in the main scanning direction is longer than the ejection time difference between other adjacent dots, is set to be smaller than the distance in the main scanning direction between other nozzles.

11. The liquid droplet ejection apparatus as defined in claim 1, wherein droplet ejection control is performed which places the dots so that the distance between dots in the main scanning direction whereby the ejection time difference between adjacent dots in the main scanning direction differs from the ejection time difference between other adjacent dots is caused to differ from the distance between dots in the main scanning direction for other adjacent dots for at least one of the ejection heads.

12. The liquid droplet ejection apparatus as defined in claim 1, wherein a plurality of nozzles are formed in the ejection head in line with the sub-scanning direction along the relative movement direction in the specific time difference nozzle pair position, and droplet ejection is performed selectively from the plurality of nozzles in the same sub-scanning direction line.

13. An image forming apparatus, comprising:

the liquid droplet ejection apparatus as defined in claim 1, wherein the image forming apparatus forms an image on the ejection receiving medium using liquid droplets ejected from the nozzles.

14. A liquid droplet ejection apparatus, comprising:

a plurality of ejection heads having an ejection surface in which nozzles for ejecting droplets of liquid towards an ejection receiving medium are arranged two-dimensionally, wherein one ejection head ejects the droplets of the liquid of the same color;

a conveying device which conveys at least one of the ejection heads and the ejection receiving medium in a fixed direction to cause relative movement of the ejection heads and the ejection receiving medium in a relative movement direction; and a droplet ejection control device which performs droplet ejection control whereby droplets of the liquid are ejected from the ejection heads towards the ejection receiving medium together with the relative movement caused by the conveying device, and a row of dots is formed by the droplets of the liquid landing on the ejection receiving medium in which at least some of the dots overlap in a main scanning direction substantially perpendicular to the relative movement direction, wherein when a position between nozzles at which a droplet ejection time difference between adjacent dots in the main scanning direction in one ejection head differs from a droplet ejection time difference between other adjacent dots is referred to as a specific time difference nozzle pair position in a corresponding ejection head, the ejection head is positioned so that the specific time difference nozzle pair position differs in the main scanning direction between at least two of the ejection heads, and wherein the position between nozzles at which the droplet ejection time difference between the adjacent dots of the same color in the main scanning direction in one ejection head differs from the droplet ejection time difference between other adjacent dots is referred to as the specific time difference nozzle pair position in a corresponding ejection head.

15. An image forming apparatus, comprising:

the liquid droplet ejection apparatus as defined in claim 14, wherein the image forming apparatus forms an image on the ejection receiving medium using liquid droplets ejected from the nozzles.

* * * * *